US006167719B1

(12) United States Patent
Yakumaru et al.

(10) Patent No.: US 6,167,719 B1
(45) Date of Patent: Jan. 2, 2001

(54) COMPRESSOR FOR REFRIGERATION CYCLE

(75) Inventors: Yuichi Yakumaru, Shiga; Yukio Watanabe, Kyoto; Akira Fujitaka, Shiga; Hironao Numoto, Shiga; Shigehiro Sato, Shiga; Kanji Haneda, Shiga; Yoshinori Kobayashi, Shiga, all of (JP)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 09/285,678

(22) Filed: Apr. 5, 1999

(30) Foreign Application Priority Data

Apr. 8, 1998 (JP) ..... 10-112763

(51) Int. Cl.[7] ..... F25B 43/00

(52) U.S. Cl. ..... 62/468; 62/84; 62/193; 62/469

(58) Field of Search ..... 62/468, 469, 470, 62/192, 193, 84

(56) References Cited

U.S. PATENT DOCUMENTS

| | | | | |
|---|---|---|---|---|
| 5,103,648 | * | 4/1992 | Barbier | 62/126 |
| 5,345,785 | | 9/1994 | Sekigami et al. . | |
| 5,531,080 | | 7/1996 | Hirahara et al. . | |
| 5,542,266 | * | 8/1996 | Suzuki et al. | 62/469 |
| 5,580,233 | | 12/1996 | Wakana et al. . | |
| 6,026,649 | * | 2/2000 | Adachi | 62/84 |

FOREIGN PATENT DOCUMENTS

| | | |
|---|---|---|
| 0 716231 | 6/1996 | (EP) . |
| WO 95/35462 | 12/1995 | (WO) . |

OTHER PUBLICATIONS

Patent Abstracts of Japan, vol. 13, No. 310, Jul. 14, 1989, Japanese Publication No. 01096488, publ. Apr. 14, 1989, A. Kazunari, Daikin Ind. Ltd., "Horizontal Scroll Type Compressor".

* cited by examiner

*Primary Examiner*—William Doerrler
*Assistant Examiner*—Marc Norman
(74) *Attorney, Agent, or Firm*—Armstrong, Westerman, Hattori, McLeland & Naughton

(57) ABSTRACT

In a compressor of a refrigeration cycle using an HC-based refrigerant and a lubricant having specific gravity greater than that of the HC-based refrigerant and having no or no or less mutual solubility with the HC-based refrigerant, an oil reservoir is formed on a bottom of the compressor, the oil reservoir is provided at its portion with a recess, a suction port of a lubricant suction pipe for supplying the lubricant to a compressor mechanism is provided in the recess. With this feature, it is possible to sufficiently supply the lubricant to the compressor even when the lubricant has no or less mutual solubility, so that even if the amount of the lubricant is reduced, the lubricant can be sufficiently sucked from an inlet port of a lubricant pumping pipe and supplied to the compressor mechanism.

12 Claims, 9 Drawing Sheets

COMPRESSOR FOR REFRIGERATION CYCLE

TECHNICAL FIELD

The present invention relates to a compressor used for a refrigeration cycle using an HC-based refrigerants such as propane and isobutane, and using, in the compressor, a lubricant having no or less mutual solubility with the refrigerant.

BACKGROUND TECHNIQUE

HCFC-based refrigerants such as R22, which are stable compounds and composed of hydrogen, chlorine, fluorine and carbon, are currently utilized in an air conditioner.

However, HCFC-based refrigerants rise into the stratosphere and decomposed ozone, leading to the destruction of the ozone layer.

In recent years, HFC-based refrigerants began to be utilized as alternative refrigerants of HCFCs, but these HFC-based refrigerants have the nature for facilitating global warming.

Therefore, a study is started to employ a HC-based refrigerant which does not destroy the ozone layer or largely affect global warming.

However, since this HC-based refrigerant is flammable, it is necessary to prevent explosion or ignition so as to ensure safety.

As one method for ensuring safety, there is a method to reduce the amount of refrigerant to be used. That is, the flammable refrigerant is not ignited or exploded unless its concentration exceeds the marginal level. Therefore, it is possible to prevent the ignition or explosion, and to largely reduce the dangerous probability by reducing the amount of refrigerant to be charged. The reduction of the amount of refrigerant to be used also leads to the effective utilization of resources.

In order to reduce the amount of the refrigerant to be charged into the refrigeration cycle, it is effective to use a lubricant having no or less mutual solubility with the refrigerant, thereby reducing the amount of the refrigerant dissolved into the lubricant.

However, when the lubricant having no or less mutual solubility with the refrigerant is used, since the refrigerant and the lubricant separate from each other, there is a possibility that only the liquid refrigerant, including almost no lubricant, is pumped up, depending upon the amount of accumulated lubricant or refrigerant. Especially, unlike HCFC-based refrigerant, CFC-based refrigerant and the like, HC-based refrigerant itself does not have lubricity. Therefore, if the above-described possibility comes true, the lubricating operation is not carried out smoothly, and it is necessary to pay sufficient attention to this problem.

If the refrigerant having no or less mutual solubility with the refrigerant is discharged from a compressor together with the refrigerant, since the lubricant circulates through a refrigeration cycle in a state in which the lubricant separates from the refrigerant, the lubricant stops in the refrigeration cycle, and the lubricant does not easily return to the compressor. If the amount of lubricant returning to the compressor is small, since the amount of lubricant in the compressor is reduced, the above-described problem is prone to be generated.

Thereupon, it is an object of the present invention to make it possible to sufficiently supply a lubricant to a compressor mechanism even when the lubricant has no or less mutual solubility, so that even if the amount of the lubricant is reduced, the lubricant can be sufficiently sucked from an inlet port of a lubricant pumping pipe and supplied to the compressor mechanism.

DISCLOSURE OF THE INVENTION

To achieve the above object, according to a first aspect, there is provided a compressor of a refrigeration cycle using an HC-based refrigerant and a lubricant having specific gravity greater than that of the HC-based refrigerant and having no or less mutual solubility with the HC-based refrigerant, wherein an oil reservoir is formed on a bottom of the compressor, the oil reservoir is provided with a recess, and a suction port of a lubricant suction pipe for supplying the lubricant to a compressor mechanism is provided in the recess. With this feature, a small amount of the refrigerant can effectively be utilized, and it is possible to reduce the amount of the liquid refrigerant mixed into the lubricant.

According to a second aspect, a lower space of the recess is narrower than an upper space of the recess. With this feature, the liquid level of the lubricant can further be heightened.

According to a third aspect, the recess is provided with a slope. With this feature the lubricant can be collected easily.

According to a fourth aspect, the recess is formed into a conical shape. With this feature, even when the amount of the lubricant is extremely reduced, the small amount of the refrigerant can effectively be utilized.

According to a fifth aspect, there is provided a compressor of a refrigeration cycle using an HC-based refrigerant and a lubricant having specific gravity greater than that of the HC-based refrigerant and having no or less mutual solubility with the HC-based refrigerant, wherein a suction port of a lubricant suction pipe for supplying the lubricant to a compressor mechanism is disposed around a corner of a bottom of the compressor mechanism, the compressor is inclined so that the corner of the bottom forms an oil reservoir. With this feature, if the compressor is inclined, the liquid level in the oil reservoir can be heightened.

According to a sixth aspect, there is provided a compressor of a refrigeration cycle using an HC-based refrigerant and a lubricant having specific gravity greater than that of the HC-based refrigerant and having no or less mutual solubility with the HC-based refrigerant, wherein the compressor includes an oil reservoir for collecting the lubricant, and a lubricant suction pipe for supplying the lubricant in the oil reservoir to a compressor mechanism, the oil reservoir is provided with a float made of material having specific gravity equal to or slightly lighter than that of the lubricant. By providing such a float, the liquid level can be heightened.

According to a seventh aspect, the compressor further comprises a liquid level detecting mechanism for detecting a liquid level in the oil reservoir, and a float locking mechanism for holding the float at a predetermined height, wherein when the liquid level detecting mechanism detects that the amount of the lubricant is reduced, the float locking mechanism is operated to drop the float into the oil reservoir. When the lubricant is reduced, the liquid level of the lubricant can be heightened by dropping the float into the oil reservoir so that the lubricant can reliably be supplied.

According to an eighth aspect, the lubricant suction pipe is provided with a suction port comprising a groove or a plurality of openings at the end thereof, the float is slidably provided around the lubricant suction pipe, and the suction port is opened and closed by the float. With this feature, it is possible to prevent the liquid refrigerant from being sucked.

According to a ninth aspect, there is provided a compressor of a refrigeration cycle using an HC-based refrigerant and a lubricant having specific gravity greater than that of the HC-based refrigerant and having no or less mutual solubility with the HC-based refrigerant, wherein the compressor is provided therein with a cylindrical separator, the separator includes an oil feed pipe for sucking the lubricant in an oil reservoir, a suction port of the lubricant suction pipe is disposed at a lower portion within the separator, and a discharge port of the oil feed pipe is disposed at an upper portion within the separator. By providing such a separator, only the lubricant can be supplied.

In such a compressor, it is preferable that propane or isobutane is used as the HC-based refrigerant, and carbonate compound is used as the lubricant. Further, in the lubricant, it is preferable that the number of carbon forming carbonic acid ester bond occupies 10 atomic % of all the number of carbon forming the carbonate compound.

BEST MODE FOR CARRYING OUT THE INVENTION

An embodiment of a compressor used in the present invention will be explained below.

In the following embodiments, an HC-based refrigerant, such as propane and isobutane, is used, and a lubricant having mutual solubility with this HC-based refrigerant as small as 5 wt % or less. An example of such a refrigerant is carbonate compound, and especially, carbonate compound in which the number of carbon forming carbonic acid ester bond occupies 10 atomic % of all the number of carbon forming the carbonate compound is used.

Figure 1:
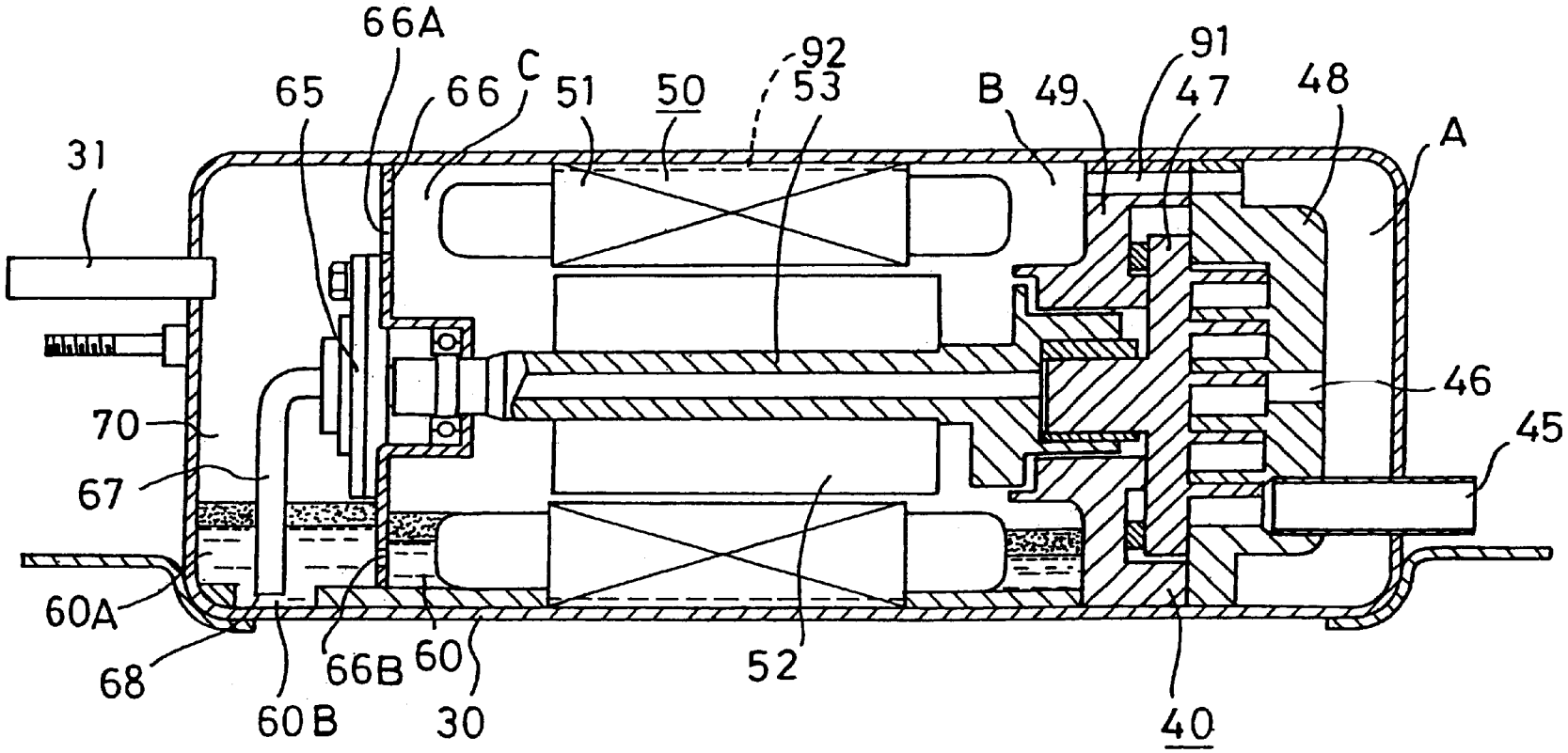
FIG. 1 is a sectional view of a compressor according to an embodiment of the present invention.

FIG. 1 is a sectional view of the compressor according to a first embodiment.

The compressor shown in FIG. 1 is a horizontal high pressure type compressor having a cylindrical shell 30 in which a compressor mechanism 40 and a motor mechanism 50 are provided. The shell 30 is of a cylindrical shape whose longitudinal size is greater than diametrical size, and the compressor mechanism 40, the motor mechanism 50 and a pump 65 are laterally disposed sequentially. The illustrated compressor is of a scroll type, and the compressor mechanism 40 comprises two scroll laps 47, 48, an Oldham ring 49, and the like. A discharge port 46 of the compressor mechanism 40 is provided in a fixed side scroll lap 48, and an intake port 45 connected to an accumulator provided in the refrigeration cycle is provided in the compressor mechanism 40. The motor mechanism 50 comprises a stator 51, a rotor 52 and the like. The rotor 52 and the scroll lap 47 of the compressor mechanism 40 are connected to each other through a crankshaft 53. Further, a refrigerant discharge pipe 31 is provided at the side of an oil separating chamber 70, and is connected to a condenser of the refrigeration cycle. An oil partition 66 is provided between the motor mechanism 50 and the oil separating chamber 70. The oil partition 66 is provided with an opening 66A through which the refrigerant passes, and with a passage 66B through which the lubricant passes. An oil reservoir 60 is provided on a bottom of the shell at a position closer to the oil separating chamber 70 than the compressor mechanism 40. The oil separating chamber 70 is formed at its lower portion with an oil reservoir 60A which functions as an oil supply portion. A suction port 68 of a lubricant suction pipe 67 for supplying the lubricant to the compressor mechanism 40 is disposed in a recess 60B of the oil reservoir 60A. The crankshaft 53 and the Oldham ring 49 are formed with oil supply groove for supplying the lubricant pumped up from the oil reservoir 60 by the pump 65 into the scroll laps 47 and 48. A gap 92 through which the refrigerant gas passes is formed between the shell 30 and the stator 51 of the motor mechanism 50. The compressor mechanism 40 is formed with a refrigerant communication hole 91 for communicating a space A at the side of the discharge port 46 with a space B at the side of the motor mechanism 50.

The flow of the refrigerant gas and the lubricant in the compressor will be explained.

First, the refrigerant sucked from the accumulator into the scroll laps 47 and 48 of the compressor mechanism 40 through the intake port 45 is compressed with the turning movement of the movable side scroll lap 47. The compressed high pressure refrigerant gas is discharged from the discharge port 46 into the space A. The refrigerant discharged into the space A is introduced into the space B between the compressor mechanism 40 and the motor mechanism 50 through the refrigerant communication hole 91, and introduced into a space C through the gap 92 between the stator 51 and the shell 30. Then, the refrigerant passes through the opening 66A provided in the oil partition 66 and reaches the oil separating chamber 70, and is discharged from the refrigerant discharge pipe 31 out of the shell 30.

The lubricant accumulated in the supplying oil reservoir 60A is pumped up by the pump 65 through the suction port 68 of the lubricant suction pipe 67, and is supplied to sliding surfaces of the scroll laps 47, 48 and the Oldham ring 49 through the oil supply grooves formed in the crankshaft 53 of the compressor mechanism 40, Oldham ring 49 and the like. Then, the lubricant supplied into the compressor mechanism 40 is discharged from the discharge port 46 into the shell 30 together with the refrigerant, and is moved in the same manner as the refrigerant gas. However, a portion of the lubricant discharged together with the refrigerant is separated from the refrigerant when the lubricant passes through the motor mechanism 50. The portion of the lubricant, which passed through the motor mechanism 50 together with the refrigerant gas, is separated from the refrigerant in the oil separating chamber 70. The lubricant which is separated from the refrigerant drops into the oil reservoir 60 provided on the bottom of the shell 30, and is collected therein. The lubricant which dropped into the oil reservoir 60 at the lower portion of the motor mechanism 50 is introduced into the oil reservoir 60A through the passage 66B.

At that time, the refrigerant compressed by the compressor mechanism 40 flows through the space A, the space B, the space C and the oil separating chamber 70 in this order as described above. The refrigerant communication hole 91 is provided between the spaces A and B, the motor mechanism 50 is provided between the spaces B and C, and the oil partition 66 is provided between the space C and the oil separating chamber 70. Therefore, the pressures in each of the spaces are slightly different. Thus, lubricant is accumulated in the supplying oil reservoir 60A more than in the oil reservoir 60, and the liquid level in the oil reservoir 60A is higher than liquid level in the oil reservoir 60. Further, since the tip end of the lubricant suction pipe 67 is inserted into the recess 60B of the oil reservoir 60A, even when the amount of the lubricant in the shell 30 is small, the lubricant is easily collected in the recess 60B, and it is possible to reliably pump up the lubricant.

Figure 2:
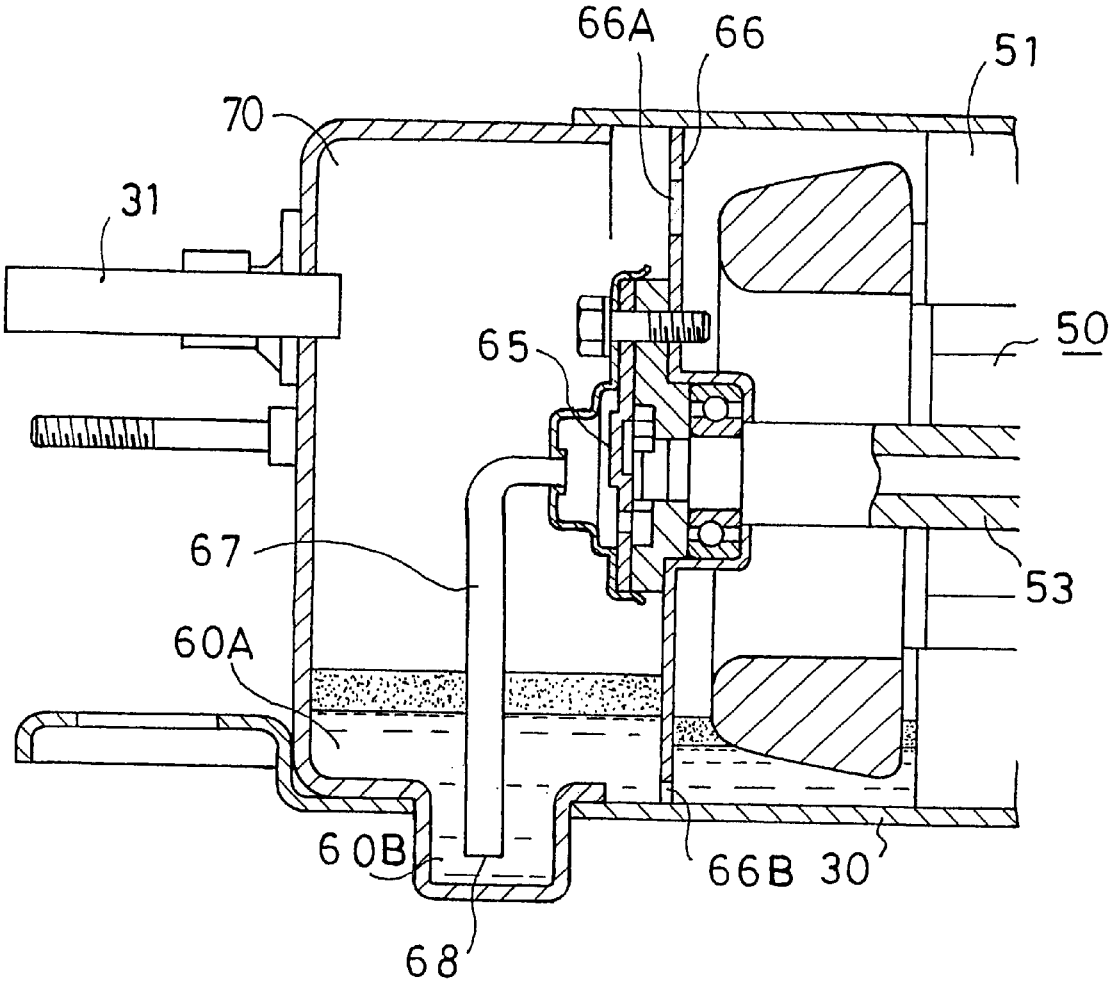
FIG. 2 is a sectional view of an essential portion of a compressor according to another embodiment of the invention.

FIG. 2 is a sectional view of an essential portion of a compressor according to a second embodiment of the present invention.

In the compressor shown in FIG. 2, the shell 30 is dented such that the recess 60B is formed in a portion of the oil reservoir 60A. With such a structure, even if the amount of the lubricant in the shell 30 is small, the lubricant is collected in the recess 60B, and it is possible to reliably pump up the lubricant by the lubricant suction pipe 67 to supply the lubricant to the compressor mechanism 40. Further, by providing such a recess 60B, it is possible to reduce the mixing amount of liquid refrigerant which exists on the liquid level of the lubricant.

Figure 3:
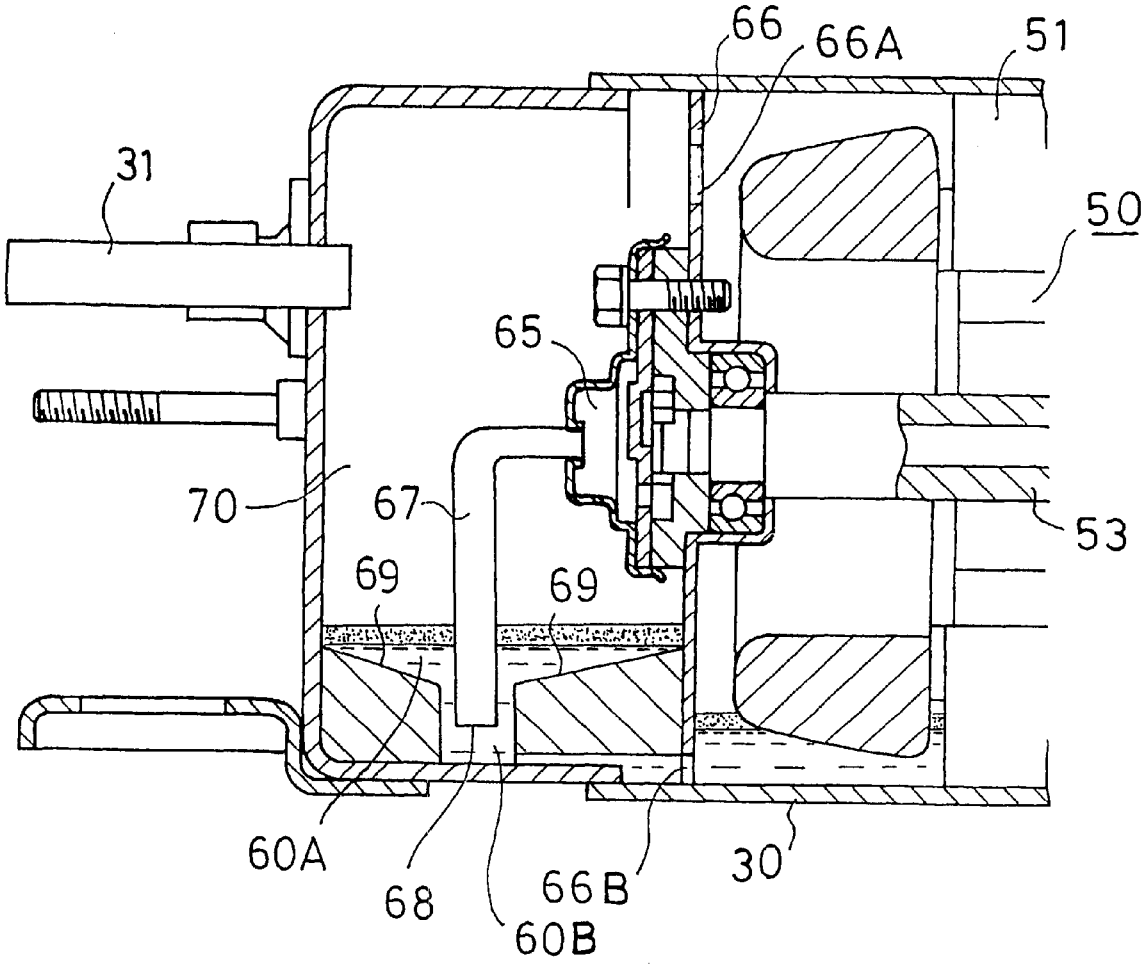
FIG. 3 is a sectional view of an essential portion of a compressor according to another embodiment of the invention.

FIG. 3 is a sectional view of an essential portion of a compressor according to a third embodiment of the invention.

In the compressor shown in FIG. 3, an upper surface of the recess 60B provided on the bottom of the shell 30 is inclined, so that the lubricant can easily flow into the recess 60B. With such a structure, the lubricant separated from the refrigerant in the oil separating chamber 70 can reliably be collected in the oil reservoir 60A. Further, since the liquid level of the lubricant is heightened, the mixing amount of the liquid refrigerant can be reduced.

Figure 4:
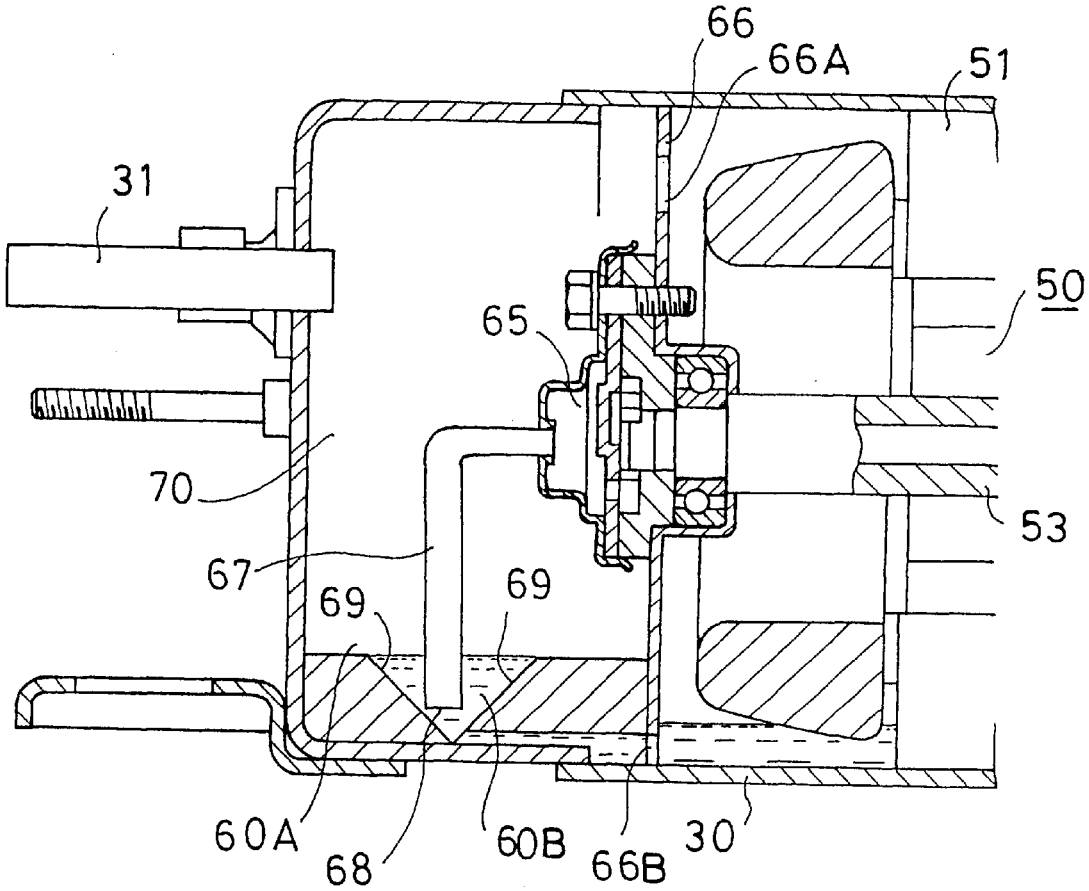
FIG. 4 is a sectional view of an essential portion of a compressor according to another embodiment of the invention.

FIG. 4 is a sectional view of an essential portion of a compressor according to a fourth embodiment of the invention.

In the compressor shown in FIG. 4, the recess 60B of the oil reservoir 60A provided on the bottom of the shell 30 is formed into a conical shape so that the lubricant separated from the refrigerant in the oil separating chamber 70 flows down on the conical slope 69, and reliably flows into the recess 60B, and is collected therein. Further, since the liquid level of the lubricant is heightened, the mixing amount of the liquid refrigerant can be reduced.

Figure 5:
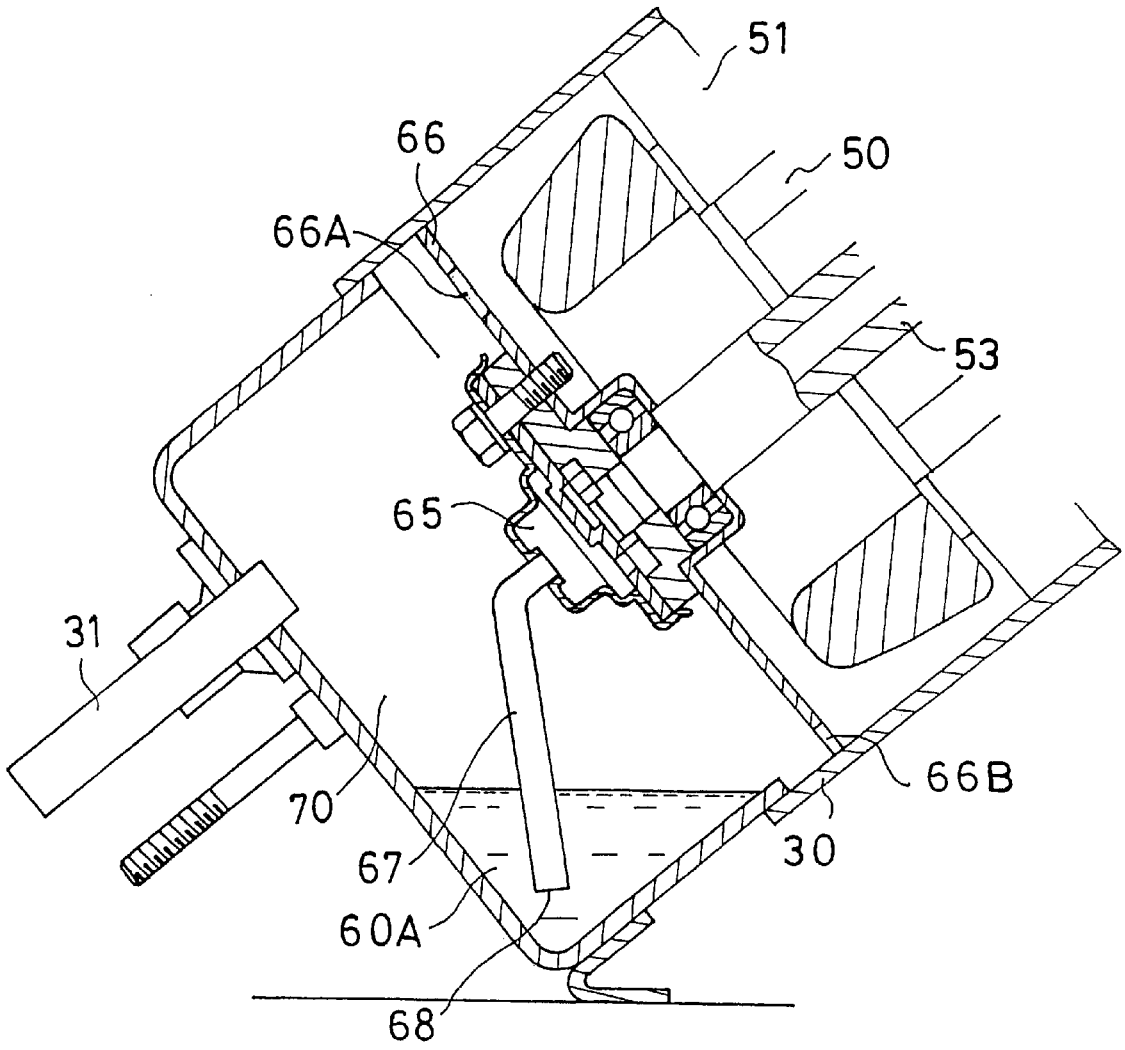
FIG. 5 is a sectional view of an essential portion of a compressor according to another embodiment of the invention.

FIG. 5 is a sectional view of an essential portion of a compressor according to a fifth embodiment of the invention.

In the compressor shown in FIG. 5, the suction port 68 of the lubricant suction pipe 67 is provided around the corner of the bottom within the shell 30, the entire compressor is inclined such that the position of the stator 51 of the motor mechanism 50 comes higher than the highest liquid level of the lubricant. In this case, the liquid level in the oil reservoir 60A can be heightened without changing the structure unlike the above embodiments, it is possible to reliably supply the lubricant to the compressor mechanism 40.

Figure 6:
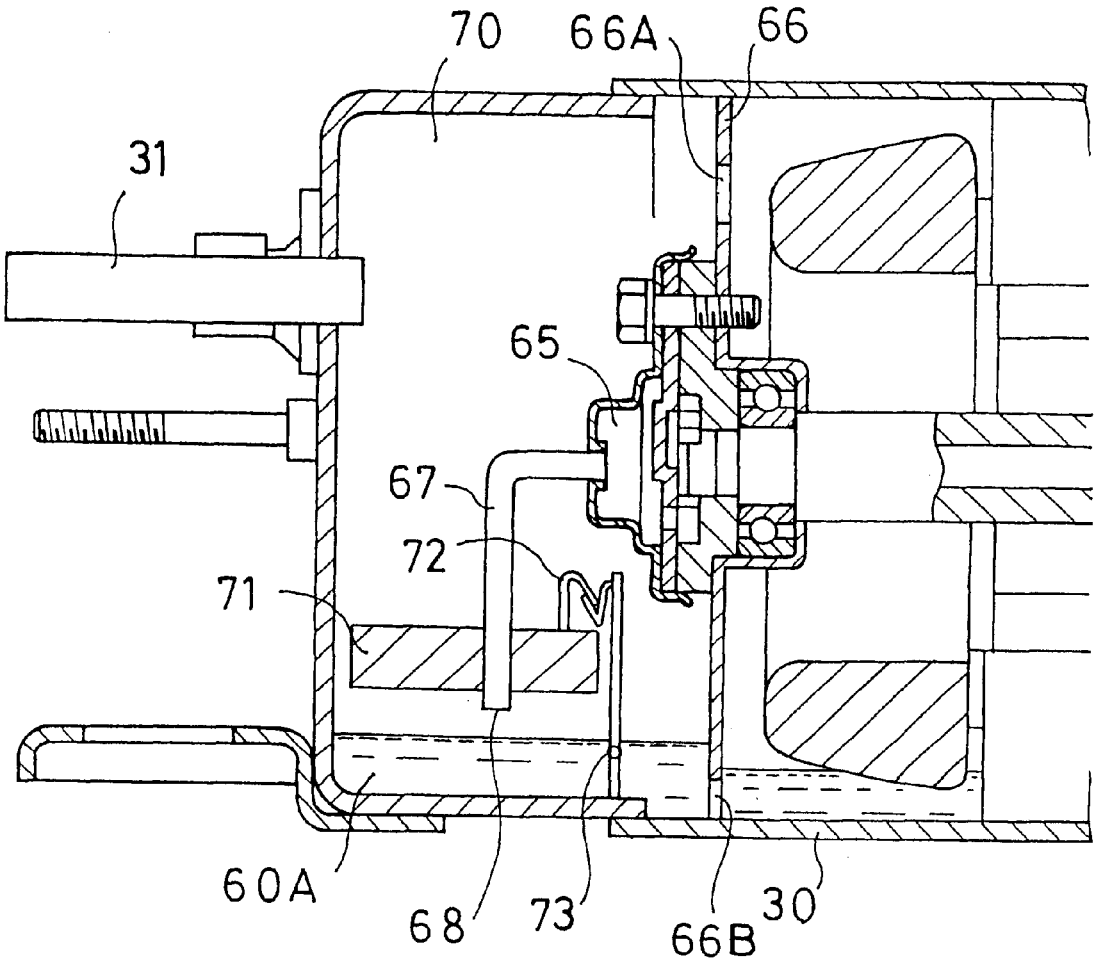
FIG. 6 is a sectional view of an essential portion of a compressor according to another embodiment of the invention.

FIG. 6 is a sectional view of an essential portion of a compressor according to a sixth embodiment of the invention.

In the oil reservoir 60A of the compressor shown in FIG. 6, a float 71 made of material having specific gravity equal to or slightly lighter than the lubricant to be used is vertically slidably provided around the lubricant suction pipe 67. A locking mechanism 72 for the float 71 and a liquid level detection sensor 73 are provided on a wall surface of the oil reservoir 60A. The height of the liquid level in the oil reservoir 60A is detected by the liquid level detection sensor 73, and if the liquid level is lower than a predetermined value, the locking of the float 71 by the locking mechanism 72 is released by a signal from the detection sensor 73, the float 71 is dropped into the lubricant in the oil reservoir 60A so that the liquid level of the lubricant is heightened. As a result, the suction port 68 of the lubricant suction pipe 67 is located in the oil reservoir 60A sufficiently, it is possible to reliably supply the lubricant from the oil reservoir 60A to the compressor mechanism 40. When the liquid level of in the oil reservoir 60A is returned to the predetermined value, the float 71 is locked by the locking mechanism 72 to return the float 71 to the standby state.

Figure 7:
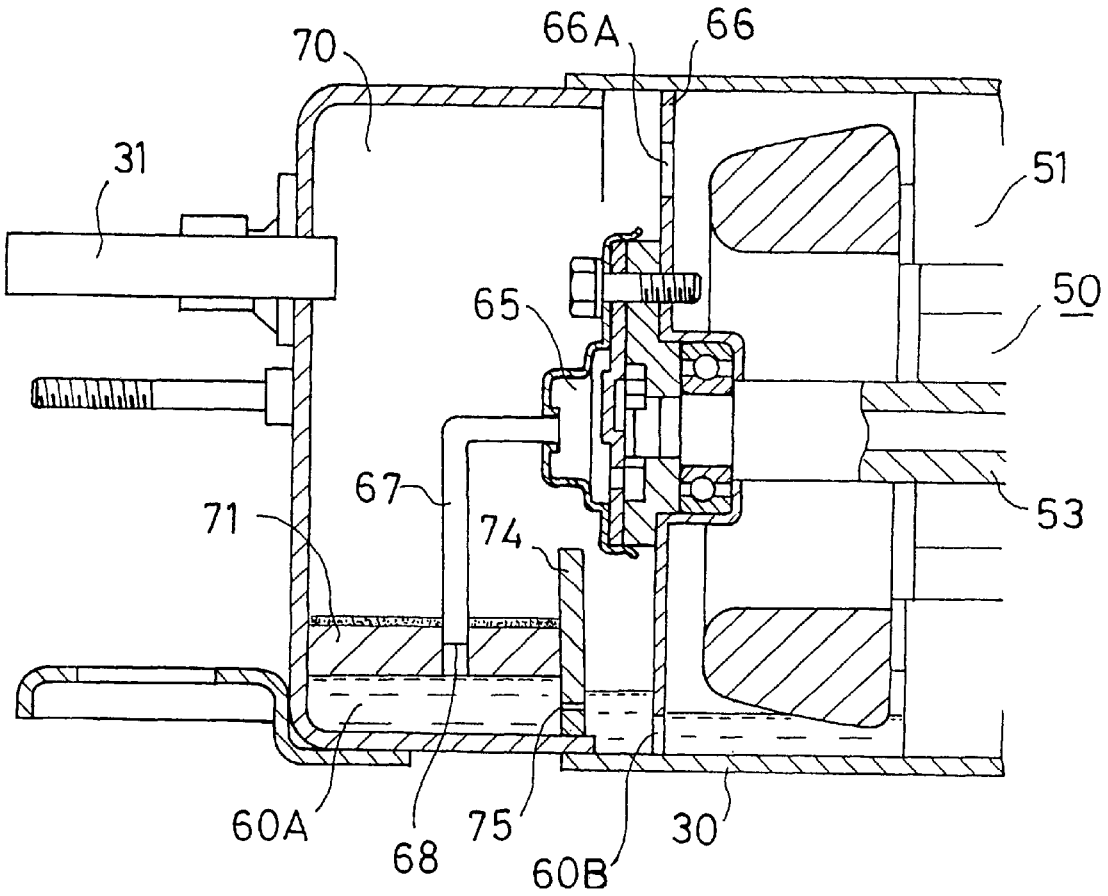
FIG. 7 is a sectional view of an essential portion of a compressor according to another embodiment of the invention.

FIG. 7 is a sectional view of an essential portion of a compressor according to a seventh embodiment of the invention.

In the compressor shown in FIG. 7, the float 71 made of material having specific gravity equal to or slightly lighter than the lubricant to be used is provided in the oil reservoir 60A, a shut-off plate 74 provided at its lower portion with a fine hole 75 is uprightly mounted in the oil reservoir 60A so that the lubricant flowing into the oil reservoir 60A from the compressor shell 30 flows in through the fine hole 75. A difference in the liquid level is generated by the shut-off plate 74 so that the liquid level in the oil reservoir 60A is held higher. In this case, when the liquid level in the oil reservoir 60A is lowered, the float 71 is dropped into the oil reservoir 60A, and the fine hole 75 is closed by the float 71, thereby preventing the liquid level in the oil reservoir 60A from lowering. The fine hole 75 is provided with a check valve so that the lubricant in the oil reservoir 60A does not flow reversely.

Figure 8:
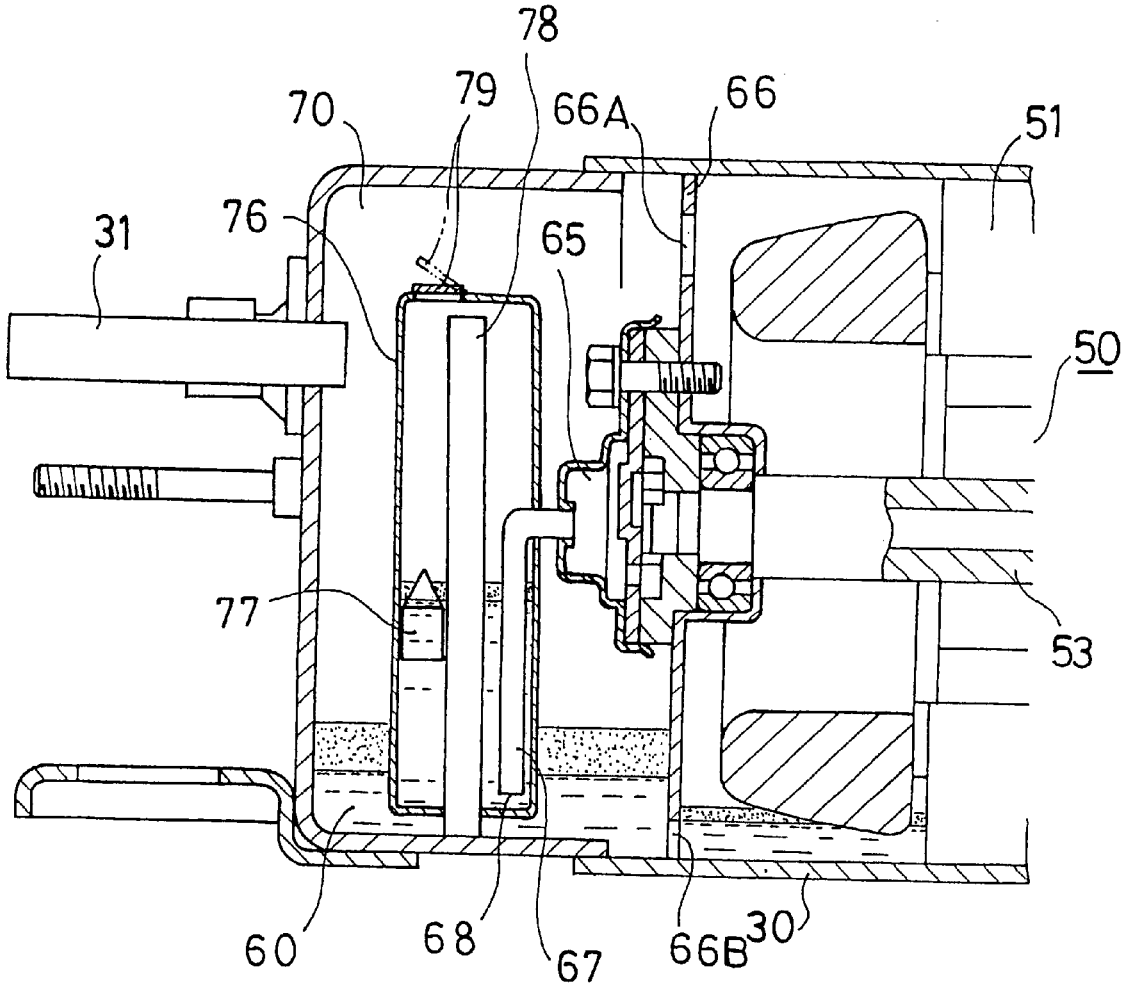
FIG. 8 is a sectional view of an essential portion of a compressor according to another embodiment of the invention.

FIG. 8 is a sectional view of an essential portion of a compressor according to an eighth embodiment of the invention.

In the compressor shown in FIG. 8, a cylindrical separator 76 is provided in the oil reservoir 60A. The separator 76 is provided at its upper portion with a valve 79. An oil feed pipe 78 is uprightly provided in the center of the separator 76, and a float 77 is vertically slidably provided outside the oil feed pipe 78. The lubricant suction pipe 67 is inserted in the separator 76, and the suction port 68 of the lubricant suction pipe 67 is opened in the separator 76.

In the present embodiment, the lubricant in the oil reservoir 60A is once introduced into the separator 76 by the oil feed pipe 78, and the lubricant collected in the separator 76 is pumped up by the lubricant suction pipe 67. Since only the lubricant is introduced from the oil reservoir 60A into the separator 76, only the lubricant exists in the separator 76. If the amount of lubricant in the oil reservoir 60A is largely reduced and the liquid refrigerant is mixed into the lubricant, and such a lubricant including the refrigerant is introduced into the separator 76, since the liquid refrigerant and the lubricant are separated from each other in the separator 76, the lubricant is collected in the lower portion of the separator 76. Therefore, the liquid refrigerant is hardly pumped up from the lubricant suction pipe 67. If the separator 76 is fully filled, the float 77 provided in the separator 76 moves upward to push and open the valve 79. Therefore, the liquid refrigerant collected in upper portion within the separator 76 is discharged out from the separator 76.

Figure 9:
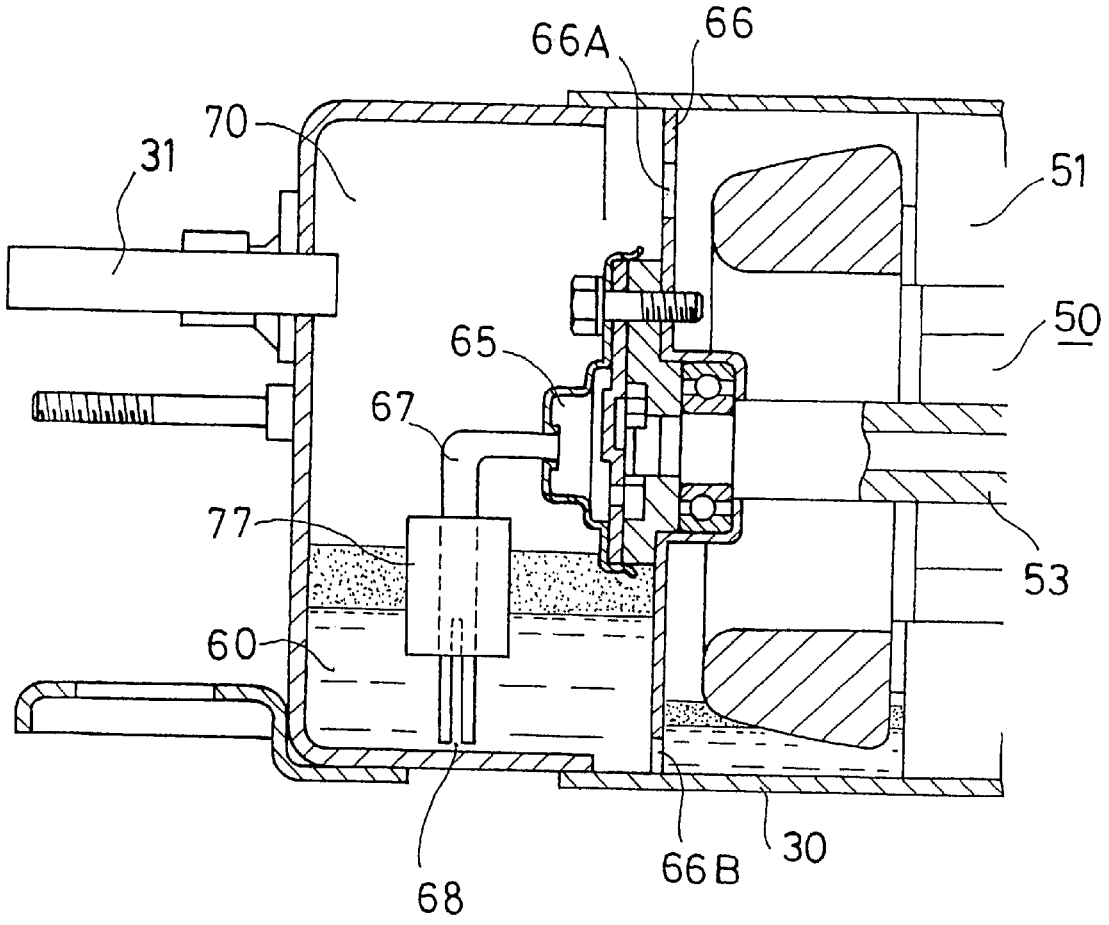
FIG. 9 is a sectional view of an essential portion of a compressor according to another embodiment of the invention.

FIG. 9 is a sectional view of an essential portion of a compressor according to a ninth embodiment of the invention.

In the compressor shown in FIG. 9, the suction port 68 of the lubricant suction pipe 67 inserted in the oil reservoir 60 is formed into a groove-like shape which opens in the vertical direction, and the float 77 is vertically slidably provided around the lubricant suction pipe 67.

In the present embodiment, if the amount of the lubricant in the oil reservoir 60 is reduced and the liquid level is lowered, the float 77 is also lowered to close the upper portion of the vertically opened groove-like suction port 68 of the lubricant suction pipe 67, thereby adjusting the amount of opening of the suction port 68. Therefore, the lubricant is pumped up from a lower portion within the oil reservoir 60 from the suction port 68 of the lubricant suction pipe 67, and it is possible to prevent the refrigerant from being mixed in the lubricant. The shape of the vertically opened groove-like suction port 68 of the present embodiment should not limited to the vertical groove-like shape as shown in FIG. 9, and may be triangular shape whose lower portion is spread. If the suction port 68 is formed into the triangular shape whose lower portion is spread in this manner, even when the amount of the lubricant is reduced and the float 77 is lowered, so that a portion of the suction port 68 is closed, the amount of pumped lubricant should not be extremely reduced. A plurality of openings may be formed.

As explained above, according to the present invention, even if a lubricant having no or less mutual solubility with a refrigerant and having specific gravity greater than that of the refrigerant is used so as to reduce the amount of refrigerant, the lubricant can be sufficiently supplied to the compressor so that even if the amount of the lubricant is reduced, the lubricant can be sufficiently pumped from the suction port of the lubricant suction pipe, and can be supplied into the compressor.

What is claimed is:

1. A compressor of a refrigeration cycle using an HC-based refrigerant and a lubricant having specific gravity greater than that of said HC-based refrigerant and having no or less mutual solubility with said HC-based refrigerant, wherein an oil reservoir is formed on a bottom of said compressor, said oil reservoir is provider at its portion with a recess, a suction port of a lubricant suction pipe for supplying said lubricant to a compressor mechanism is provided in said recess.

2. A compressor of a refrigeration cycle according to claim 1, wherein a lower space of said recess is narrower than an upper space of said recess.

3. A compressor of a refrigeration cycle according to claim 1 or 2, wherein said recess is provided with a slope.

4. A compressor of a refrigeration cycle according to claim 1, wherein said recess is formed into a conical shape.

5. A compressor of a refrigeration cycle using an HC-based refrigerant and a lubricant having specific gravity greater than that of said HC-based refrigerant and having no or less mutual solubility with said HC-based refrigerant, wherein a suction port of a lubricant suction pipe for supplying said lubricant to a compressor mechanism is disposed around a corner of a bottom of said compressor, said compressor is inclined so that said corner of said bottom forms an oil reservoir.

6. A compressor of a refrigeration cycle using an HC-based refrigerant and a lubricant having specific gravity greater than that of said HC-based refrigerant and having no or less mutual solubility with said HC-based refrigerant, wherein said compressor includes an oil reservoir for collecting said lubricant, and a lubricant suction pipe for supplying said lubricant in said oil reservoir to a compressor mechanism, said oil reservoir is provided with a float made of material having specific gravity equal to or slightly lighter than that of said lubricant.

7. A compressor of a refrigeration cycle according to claim 6, further comprising a liquid level detecting mechanism for detecting a liquid level in said oil reservoir, and a float locking mechanism for holding said float at a predetermined height, wherein when said liquid level detecting mechanism detects that the amount of said lubricant is reduced, said float locking mechanism is operated to drop said float into said oil reservoir.

8. A compressor of a refrigeration cycle according to claim 6, wherein said lubricant suction pipe is provided with a suction port which is provided with a groove or a plurality of openings at the end thereof, said float is slidably provided around said lubricant suction pipe, and said suction port is opened and closed by said float.

9. A compressor of a refrigeration cycle using an HC-based refrigerant and a lubricant having specific gravity greater than that of said HC-based refrigerant and having no or less mutual solubility with said HC-based refrigerant, wherein said compressor is provided therein with a cylindrical separator, said separator includes an oil feed pipe for sucking said lubricant in an oil reservoir, a suction port of said lubricant suction pipe is disposed at a lower portion within said separator, and a discharge port of said oil feed pipe is disposed at an upper portion within said separator.

10. A compressor of a refrigeration cycle according to any one of claims 1, 2, and 4 to 9, wherein propane or isobutane is used as said HC-based refrigerant, and carbonate compound is used as said lubricant.

11. A compressor of a refrigeration cycle according to any one of claims 1, 2 and 4 to 9, wherein in said lubricant, the number of carbon forming carbonic acid ester bond occupies 10 atomic % of all the number of carbon forming the carbonate compound.

12. A compressor of a refrigeration cycle using an HC-based refrigerant and a lubricant having specific gravity greater than that of said HC-based refrigerant and having no or low mutual solubility with said HC-based refrigerant, wherein a suction port of a lubricant suction pipe for supplying said lubricant to a compressor mechanism is disposed to project into a corner of a bottom of said compressor, said compressor is inclined so that said corner of said bottom forms an oil reservoir, and the number of carbon forming carbonic acid ester bonds occupy 10 atomic % of all the number of carbon forming the carbonate compound.

* * * * *